United States Patent [19]

Monsheimer et al.

[11] 4,278,432

[45] Jul. 14, 1981

[54] SOAKING METHOD

[75] Inventors: Rolf Monsheimer; Ernst Pfleiderer, both of Darmstadt, Fed. Rep. of Germany

[73] Assignee: Röhm GmbH, Darmstadt, Fed. Rep. of Germany

[21] Appl. No.: 167,709

[22] Filed: Jul. 11, 1980

[30] Foreign Application Priority Data

Jul. 23, 1979 [DE] Fed. Rep. of Germany ..... 2929844

[51] Int. Cl.[3] ..... C14C 1/04

[52] U.S. Cl. ..... 8/94.18; 8/94.16; 435/265

[58] Field of Search ..... 8/94.16, 94.18; 435/265

[56] References Cited

U.S. PATENT DOCUMENTS

| | | | |
|---|---|---|---|
| 1,973,130 | 9/1934 | Turley et al. | 8/94.16 |
| 2,174,497 | 9/1939 | Hill | 8/94.16 |
| 2,923,595 | 2/1960 | Heyden et al. | 8/94.18 |
| 4,175,922 | 11/1979 | Eckert et al. | 8/94.16 |

FOREIGN PATENT DOCUMENTS

| | | | |
|---|---|---|---|
| 2404789 | 8/1975 | Fed. Rep. of Germany | 8/94.33 |

OTHER PUBLICATIONS

Chem. Abstract, vol. 68, 96688h; vol. 50, 594c, vol. 82, 32473r, vol. 67, 84768a.

Chem. Abstract, vol. 79, 54900t.

*Primary Examiner*—Joseph L. Schofer

*Assistant Examiner*—Maria Parrish Tungol

*Attorney, Agent, or Firm*—Curtis, Morris & Safford

[57] ABSTRACT

What is disclosed is a method for soaking skins or hides which comprises soaking said skins or hides in an acid bath containing at least one compound selected from the group of compounds having one of the formulas R—SH and

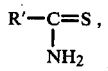

wherein R is alkyl having 2 to 3 carbon atoms, alkyl having 2 or 3 carbon atoms mono-substituted with a thiol or OH group, or R is $-(CH_2)_n-(CHR_1)-COOH$ wherein $R_1$ is hydrogen or alkyl having 1 to 6 carbon atoms or is an amino group and n is an integer from 0 to 6, or R is $R_2CO$ wherein $R_2$ is alkyl having 1 to 6 carbon atoms or phenyl, and wherein R′ is hydrogen, alkyl having 1 to 6 carbon atoms, or amino.

4 Claims, No Drawings

SOAKING METHOD

The present invention relates to a soaking method in the manufacture of leather.

In manufacturing leather, the first working step in the beamhouse consists of soaking the raw skins and hides. Soaking serves the purpose of cleaning the raw goods of adherent dirt, of removing preservative salt and other conserving agents from the skin, of dissolving water-soluble proteins at least partially out of the skin, and of returning to the skin the degree of swelling which it possessed in its native state and which it lost because of the conserving process.

Viewed chemically, the softening process brings with it a resumption of the action of microorganisms. Physically viewed, uptake of water by the skin and the condition of swelling that is brought about thereby, as well as the dissolving out from the skin of certain soluble protein components which are undesired in the tanning process, prepare for the subsequent method steps in the preparation of leather. Above all, an appropriate soaking must exclude the danger of skin damage by microorganisms. The addition to the soak of disinfecting agents, a wide variety of which have been proposed, serves this purpose. Recently, above all, soaking agent additives have been used in which a surface-active effect (surface active agent) is combined with a certain anti-bacterial effect. Enzymes are additionally employed to advantage for the removal of undesirable protein components from the skin. The uptake of water by the skin in the soaking process is influenced to a large extent by the presence of acids or alkalies. In the literature, swelling maxima are indicated at pH 2.4 and 11.6. The use of acid or alkali "boosting agents" in the softening water realtes to acid or alkali swelling. The pH region of the alkaline addition to the bath in general is above 10, since the conditions for growth of bacteria are too advantageous in the pH region from 8–10. Also, the addition of 0.1–0.3 percent of sodium sulfide is widely practiced.

Predominantly alkaline boosting in the soak has succeeded. To the extent that soaking proceeds in the acid region, either formic acid or sulfurous acid are used for boosting in preference in hydrochloric acid or sulfuric acid. The last-mentioned acids lead more easily to damage to the skin. If sulfuric acid is insufficiently washed out, opportunity is provided in the liming for the formation of calcium sulfate specks. Acid boosting agents readily lead to a loose grain in light sheep skins and goat skins.

On the other hand, the use of alkaline boosted soaks (which in addition to the effect causing swelling also exercise a certain hydrolytic effect on skin fat inhibiting surface activity) is not advised if keeping the hair (wool) intact is desirable [cf. F. Stather, "Gerbereichemie und Gerbereitechnologie") ("Tanning Chemistry and Tanning Technology") Fourth Edition, Akademie-Verlag, Berlin (1967)]. However, maintaining the hair intact has more and more become a requirement of beamhouse methods. Thus, the task arose to fashion soaking in such a manner that, on the one hand, the danger of damage to the skin by microorganisms is reduced as much as possible and, on the other hand, a swelling of the skin is effected in the most optimum manner without damaging the hair.

At the same time, the time required for the soaking should be shortened, if possible, and the process should remain ecologically unobjectionable.

It has now been found that the modern requirements of a soaking method are extensively fulfilled if soaking of the skins and hides is carried out in the acid pH region and in the presence of (1) compounds, containing —SH groups, of the formula $$R—SH,$$

wherein R is alkyl having 2–3 carbon atoms, alkyl having 2–3 carbon atoms monosubstituted with a thiol or OH group, or R is $—(CH_2)_n—(CHR_1)—COOH$, wherein $R_1$ is hydrogen or alkyl having 1 to 6 carbon atoms or is an amino group and n is an integer from 0 to 6, or R is a group $R_2CO$, wherein $R_2$ is alkyl having 1 to 6 carbon atoms or phenyl, and/or in the presence of (2) thioamide compounds of the formula $$R'—\underset{\underset{NH_2}{|}}{C}=S,$$

wherein R′ is hydrogen, alkyl having 1 to 6 carbon atoms, or amino.

The use of thioglycolic acid is particularly preferred. Also particularly mentioned are thioacetic acid, as well as mercaptoethanol. Other materials of interest are: propane thiol; alpha-thioglycerin; 1,2-dithioglycerin; 1,4-dithioerythritol; thiolactic acid; mercaptopropionic acid; 8-thioloctanoic acid; thiosalicylic acid; thiobenzoic acid; cystein; mercaptoglycine; thioacetamide; and thiourea.

In general, the addition of compounds containing —SH groups of the aforementioned formula and of the thioamide compounds of the aforementioned formula is in an amount from 0.02–0.5 percent, preferably 0.07–0.25 percent, by weight of the raw goods being treated (salt weight). The soaking method of the invention is carried out in an acid bath, i.e. in the acid pH region, preferably in the region pH 2–6.5, and particularly preferably at pH 5–6.3. The adjustment of the pH region can be brought about using suitable acids and/or acid salts or buffers to the extent that the inherent acidity of the compounds indicated above is insufficient. For example, formic acid, hydrochloric acid, sulfuric acid, and/or sulfate salts, as well as the so-called "non-swelling acids" such as naphthalene sulfonic acid, naphthol sulfonic acid, and sulfophthalic acid are mentioned. In carrying out the process of the invention, suitable emulsifying agents or pertinently employed surface-active substances can be added to the bath. Their proportion in general is between 0.2–0.5 percent, based on the salt weight, or 1–2 percent, based on the dry weight, of the skin materials being treated.

The method of the present invention can be carried out extensively in other details according to the soaking method now technically employed (cf. F. Stather, loc. cit., pages 161–165).

That embodiment in which the present invention is carried out in combination with enzymes is particularly preferred.

It is known in the art that proteases are particularly suitable for carrying out enzymatic softening in the acid pH region. For example, these materials include animal proteases such as pepsin, cathepsin, and pancreatin, plant proteases such as papain, bromelain, and ficin, as well as enzymes of microbiological origin such as fungal proteases, particularly those which can be obtained from Aspergillus species (*Asp. oryzae, Asp. saitoi, Asp.*

*parasiticus, Asp. usamii,* and *Asp. awamori*), from Penicillium species (*Penicill. roqueforti,* inter alia,) from Paecilomyces species (*Paecilomyces varioti*), from Acrocylindrium species, and from *Trametes sanguinea.*

The enzyme content is generally between 0.3–1.5 percent of the salt weight of the skin material.

The enzymes used according to the invention in general meet the requirement that their pH activity optimum lies in the acid pH region and that they show a sufficient stability in this region. The enzymatic soaking process can otherwise be carried out as discussed in German Pat. No. 1,800,891, for example.

From a practical viewpoint, the soaking method of the present invention can be carried out as follows, for example.

The term "soaking" as used herein in connection with the present invention encompasses washing, soaking, enzymatic soaking, presoaking, post-soaking or resoaking, and pretreatment or intermediate treatment for loosening hair and opening of the hide structure. The soaking method can be carried out in the usual vessels such as vats, tanning machines, drums, pits, and the like. There should be agitation for accelerating the soaking process and the agitation should be intensified as the soaking effect progresses.

In general, the temperature is in the region of room temperature, as a rule between 20° C. and 25° C., although deviations to higher or lower temperatures are possible.

The skin material preserved with salt is first washed for 1–2 hours for the removal of mud, dirt, blood, and salt, during which the aforementioned compounds can already be added. The best results are obtained if the material is treated with the aforementioned compounds in a fresh bath. For salted skin materials, as a rule between 3 and 6 hours, preferably 4–5 hours, are suitable as a soaking time. For dried materials, the soaking time is 12–18 hours, preferably 14–16 hours. Since thio compounds act as preserving agents, the addition of other preserving agents is generally not necessary.

The subsequent loosening of hair and opening of the hide structure can be carried out in the same bath, i.e. a change of bath is not necessary.

For skin materials which have a very high natural fat content or which are severely soiled, there is the possibility of using the process of the present invention in the form of a pre-treatment or intermediate treatment before loosening hair and opening the hide structure.

When carrying out the method of the invention in the form of an enzymatic soaking, additives known in the prior art for enzymatic reactions, such as activators, stabilizers, and the like can be used. The proteolytic efficacy of enzymes is commonly determined according to the Anson hemoglobin method [M. L. Anson, J. Gen. Physiol. 22 79 (1939)] or according to the Loehlein-Volhard method ["The Loehlein-Volhard Method for Determining Proteolytic Activity", Gerbereichem. Taschenbuch (Tanning Chemistry Handbook), Dresden-Leipzig (1955)] in terms of "LVU" (Loehlein-Volhard units).

In the following Examples, enzyme units derived from the Anson method are used for specifying the activity of the enzymes active in the acid region. These are designated as "Proteinase-Units (Hemoglobin)", or $U_{Hb}$,. One $U_{Hb}$ corresponds to the amount of enzyme which catalyses the liberation of hemoglobin fragments, soluble in trichloroacetic acid, in an amount equivalent to 1 micromol of tyrosine per minute at 37° C. (measured at 280 nm). 1 $mU_{Hb}=10^{-3}U_{Hb}$.

A better understanding of the present invention and of its many advantages will be had by referring to the following Examples, given by way of illustration.

EXAMPLE 1

Soaking 5,000 kg of salted calfskins are first washed for two hours, with occasional agitation, in a mixer with 80 percent of water (25° C.) for the removal of blood, dirt, and preservative salt. The bath is then discarded. Soaking follows with:

80.0 percent of water (25° C.),
0.07 percent of thioglycolic acid (85 percent techn.), and
0.15 percent of sodium chloride for six hours with occasional agitation. The pH value of the bath is 4.2 at the beginning of the soak and 5.0 at its conclusion. After this time, the hides are perfectly softened and can be limed in the same bath. By pretreatment with thioglycolic acid, a more certain and uniform loosening of the hair or jellification of the hair during liming are observed. The percentages given refer to the amount of material treated (salt weight).

EXAMPLE 2

Washing 5,000 kg of salted cowhides are washed in a drum, for removal of mud, blood, and dirt, with 200.0 percent water (25° C.) and
0.5 percent of beta-mercapto ethanol.

The treatment time is two hours. The hides are drummed 20 minutes out of every hour. The bath is then discarded. Soaking and liming are carried out in a fresh bath in the usual manner. After washing, the hides are free of mud, blood, and dirt. The pH value of the bath at the end of the washing is 6.2. The percentages given refer to the weight of the skin materials treated (salt weight).

EXAMPLE 3

Enzymatic soaking 5,000 kg of salted oxhides are first washed in a vat, for removal of blood, mud, dirt, and preservative salt, with 150 percent of water (25° C.) for two hours with occasional agitation. Then the bath is discarded. Soaking follows with:

100.0 percent of water (25° C.),
0.3 percent of papain having 120 $mU_{Hb}$/mg (pH 7.5), and
0.3 percent of fungal protease having 120 $mU_{Hb}$/mg (pH 7.5).

Agitation is effected for the first ten minutes. Then, adjustment of the pH value of the bath to 6.0 with thioacetic acid follows. The soak time amounts to five hours. The batch is agitated for 20 minutes of each hour.

At the conclusion of the soaking, fiber adhesions are completely dissolved and the skins are in a form corresponding to their native condition.

Subsequent hair loosening and opening of the hide structure can be carried out in the same bath.

The percentages given pertain to the weight of material treated (salt weight).

EXAMPLE 4

Presoaking of dried goatskins 1,000 kg of dried Chinese goatskins are introduced into a soaking vat. As a presoak, the following are added, based on the dry weight of the skins:

1000.0 percent of water (25° C.), 0.08 percent of thioglycolic acid, and 0.2 percent of urea.

For mixing, the skins were agitated at 1–2 rpm for two minutes. The treatment time was 16 hours. During this period, the batch should be agitated several times for short periods. With increasing soaking effect, the agitation must be intensified.

On the next morning, the principal soaking is carried out in a fresh bath.

EXAMPLE 5

Intermediate treatment prior to hair softening and opening of the hide structure 1,000 kg of soaked lambskins are treated after soaking in a fresh bath in a vat with:

150.0 percent of water (25° C.) and 0.03 percent of thioacetic acid.

The treatment time is two hours. The skins are agitated for 20 minutes of every hour. Thereafter, liming can be carried out in the same bath.

The intermediate treatment leads to an easier and more uniform loosening or jellification of the hair. The percentages given refer to the soak weight of the skins.

Instead of thioacetic acid, thioglycolic acid, and mercaptoethanol, other compounds of the formulas RSH and

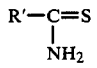

can be used in the processes of Examples 1–5 with similarly good results, such as propane thiol, alpha-thioglycerin, 1,2-dithioglycerin, 1,4-dithioerythritol, thiolactic acid, mercaptopropionic acid, 8-thioloctanoic acid, thiosalicylic acid, thiobenzoic acid, cystein, mercaptoglycine, thioacetamide, and thiourea.

What is claimed is:

1. A method for soaking skins or hides which comprises soaking said skins or hides in an acid bath containing at least one compound selected from the group of compounds having one of the formulas R—SH and

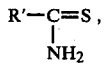

wherein R is alkyl having 2 to 3 carbon atoms, alkyl having 2 or 3 carbon atoms mono-substituted with a thiol or OH group, or R is $—(CH_2)_n—(CHR_1)—COOH$ wherein $R_1$ is hydrogen or alkyl having 1 to 6 carbon atoms or is an amino group and n is an integer from 0 to 6, or R is $R_2CO$ wherein $R_2$ is alkyl having 1 to 6 carbon atoms or phenyl, and wherein R′ is hydrogen, alkyl having 1 to 6 carbon atoms, or amino.

2. A method as in claim 1 wherein the amount of said compound or compounds in said bath is from 0.02 to 0.5 percent by weight of the skins or hides being treated.

3. A method as in claim 1 wherein the amount of said compound or compounds in said bath is from 0.07 to 0.25 percent by weight of the skins or hides being treated.

4. A method as in claim 1 wherein said acid bath additionally contains a proteolytic enzyme developing effective enzymatic activity in said acid bath.

* * * * *